US005474418A

United States Patent [19]

Wessel et al.

[11] Patent Number: 5,474,418

[45] Date of Patent: Dec. 12, 1995

[54] SELF-PRIMING CENTRIFUGAL PUMP

[75] Inventors: Manfred Wessel, Vlotho; Karl-Horst Rasche; Ingo Winkelmann, both of Löhne, all of Germany

[73] Assignee: ASV Stubbe GmbH & Co. KG, Germany

[21] Appl. No.: 311,512

[22] Filed: Sep. 23, 1994

[30] Foreign Application Priority Data

Sep. 25, 1993 [DE] Germany ..... 9314532 U

[51] Int. Cl.[6] ..... F04D 9/00

[52] U.S. Cl. ..... 415/56.5; 417/80; 417/83

[58] Field of Search ..... 415/56.1, 56.5, 415/58.4, 147, 225; 417/80, 83

[56] References Cited

U.S. PATENT DOCUMENTS

| | | | |
|---|---|---|---|
| 2,181,792 | 11/1939 | Rupp et al. | 415/147 |
| 2,247,654 | 7/1941 | Ferguson | 417/83 |
| 2,400,434 | 5/1946 | Nelson | 417/83 |
| 2,853,014 | 9/1958 | Carpenter | 417/83 |
| 2,897,764 | 8/1959 | Tracy | 417/83 |
| 2,941,474 | 6/1960 | Hall | 417/83 |
| 4,767,281 | 8/1988 | Sailer | 417/83 |
| 5,100,289 | 3/1992 | Caoduro | 417/83 |

FOREIGN PATENT DOCUMENTS

| | | | |
|---|---|---|---|
| 0052207 | 4/1977 | Japan | 417/83 |
| 0250468 | 8/1947 | Sweden | 417/83 |

*Primary Examiner*—Edward K. Look
*Assistant Examiner*—Mark Sgantzos
*Attorney, Agent, or Firm*—Blakely, Sokoloff, Taylor & Zafman

[57] ABSTRACT

A self priming pump having a pump housing including a suction passage and a discharge passage. A pump chamber with an inlet and an outlet is also provided in the pump housing. A pump impeller is arranged in the pump chamber and has a suction opening opposed to the inlet of the pump chamber. A working fluid chamber is provided in the pump housing and is connected to the outlet of the pump chamber and to the discharge passage of the pump housing. A jet pump diffuser is provided directly upstream of the pump impeller. The jet pump diffuser has an inlet which is in communication with the suction passage of the pump housing and cooperates with the outlet of a jet pump drive nozzle within the suction passage. The inlet of the drive nozzle is connected to a supply passage which is connected to a supply passage which is connected to the working fluid chamber. A bypass line leads from the suction passage to the outlet of the diffuser while bypassing the inlet thereof. The bypass line contains an automatically working valve which closes the bypass line when air is sucked in and which is opened by the reduce pressure created in the diffuser if the pump is conveying liquid medium only.

4 Claims, 1 Drawing Sheet

SELF-PRIMING CENTRIFUGAL PUMP

BACKGROUND OF THE INVENTION

1. Field of the Invention

The invention relates to a self-priming centrifugal pump for conveying a liquid medium including a pump housing which has a suction passage and a discharge passage, a pump chamber which is provided in the pump housing and has an inlet and an outlet, a pump impeller which is arranged in the pump chamber and which has a suction opening opposed to the inlet of the pump chamber, a working fluid chamber which is provided in the pump housing and which is connected to the outlet of the pump chamber and to the discharge passage in the pump housing, a jet pump diffuser which has a broadened outlet, in which a reduced pressure is produced, and a constricted inlet, the outlet of the diffuser being connected to the inlet of the pump chamber whilst the inlet of diffuser is in communication with the suction passage in the pump housing and a jet pump drive nozzle which has an inlet and an outlet, the inlet of the drive nozzle being connected to a supply passage connected to the working fluid chamber whilst the outlet of the drive nozzle within the suction passage cooperates in the manner of an injector with the inlet of the diffuser.

2. Prior Art

It is known in connection with centrifugal pumps to provide a venturi nozzle or jet pump device upstream of the pump impeller in order to produce self-priming of the liquid medium to be conveyed even when there is air in a suction passage leading upwards to the rotary pump. The diffuser tube of the jet pump device, into whose inlet the jet pump drive nozzle discharges, constitutes the sole connection between the suction passage in the pump housing and the suction opening of the pump impeller in the known self-priming centrifugal pumps of the type referred to above. When the centrifugal pump is switched on, a liquid working medium, which remains in the working medium chamber of the pump housing when the pump is switched off, is firstly pumped by the pump impeller in a circuit from the working medium space through the drive nozzle in the manner of an injector into the diffuser tube, sucked out of the diffuser tube and transferred back into the working medium space again. The working medium jet entering the diffuser tube from the drive nozzle entrains air from the suction passage in the pump housing. The air can then escape from the working medium space, for instance through the discharge passage in the pump housing which is in communication with the working fluid space. When the transfer medium drawn into the suction passage by the reduced air pressure has completely filled the suction passage and is drawn in through the diffuser tube by the pump impeller, the rotary pump builds up its ultimate discharge pressure by which the transfer medium is forced out of the discharge passage of the pump housing connected to the working medium space.

In the aforementioned known self-priming centrifugal pumps the suction efficiency and discharge performance are principally determined by the dimensioning of the drive nozzle and of the diffuser. In order to achieve the jet pump action necessary for the air intake, the diffuser inlet cooperating in the manner of an injector with the drive nozzle necessarily has a small cross-section for the transfer medium which is sucked in, whereby relatively small pumped flows are produced at full output of the rotary pump and also high flow velocities within the centrifugal pump which lead to efficiency losses. In order to change the suction efficiency of the jet pump device for the air intake and to change the suction and discharge capacity of the pump for conveying transfer medium which has been sucked in, the drive nozzle must be able to be changed or adjusted with expensive features and means.

THE INVENTION

The object of the invention is to make this principle used in the known centrifugal pumps with a jet pump device for changing the output superfluous and to avoid its disadvantages.

This object is solved by the invention by the construction of a self-priming centrifugal pump of the type referred to above with a bypass line which is connected to the suction passage and leads to the outlet of the diffuser whilst bypassing its inlet, and a valve, which is arranged in the bypass line and automatically closes it, with a valve body which opens the bypass line in the direction from the suction passage to the outlet of the diffuser, whereby acting on the valve body in the direction from the outlet of the diffuser to the suction passage there is a closing force which is smaller than an opening force which acts on the valve body and which is produced by the reduced pressure in the outlet of the diffuser at full discharge capacity of the centrifugal pump.

Advantageous embodiments of the invention are characterised in the dependent claims.

DETAILED DESCRIPTION OF THE INVENTION

Figure 2:
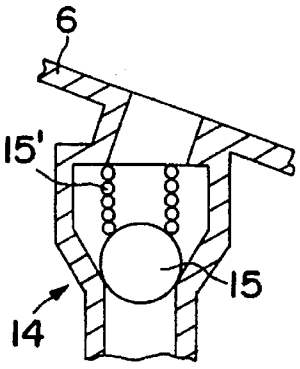
FIG. 2 is a schematic axial sectional view of the valve showing the valve body pressed by a spring onto the valve's seat.
Figure 1:
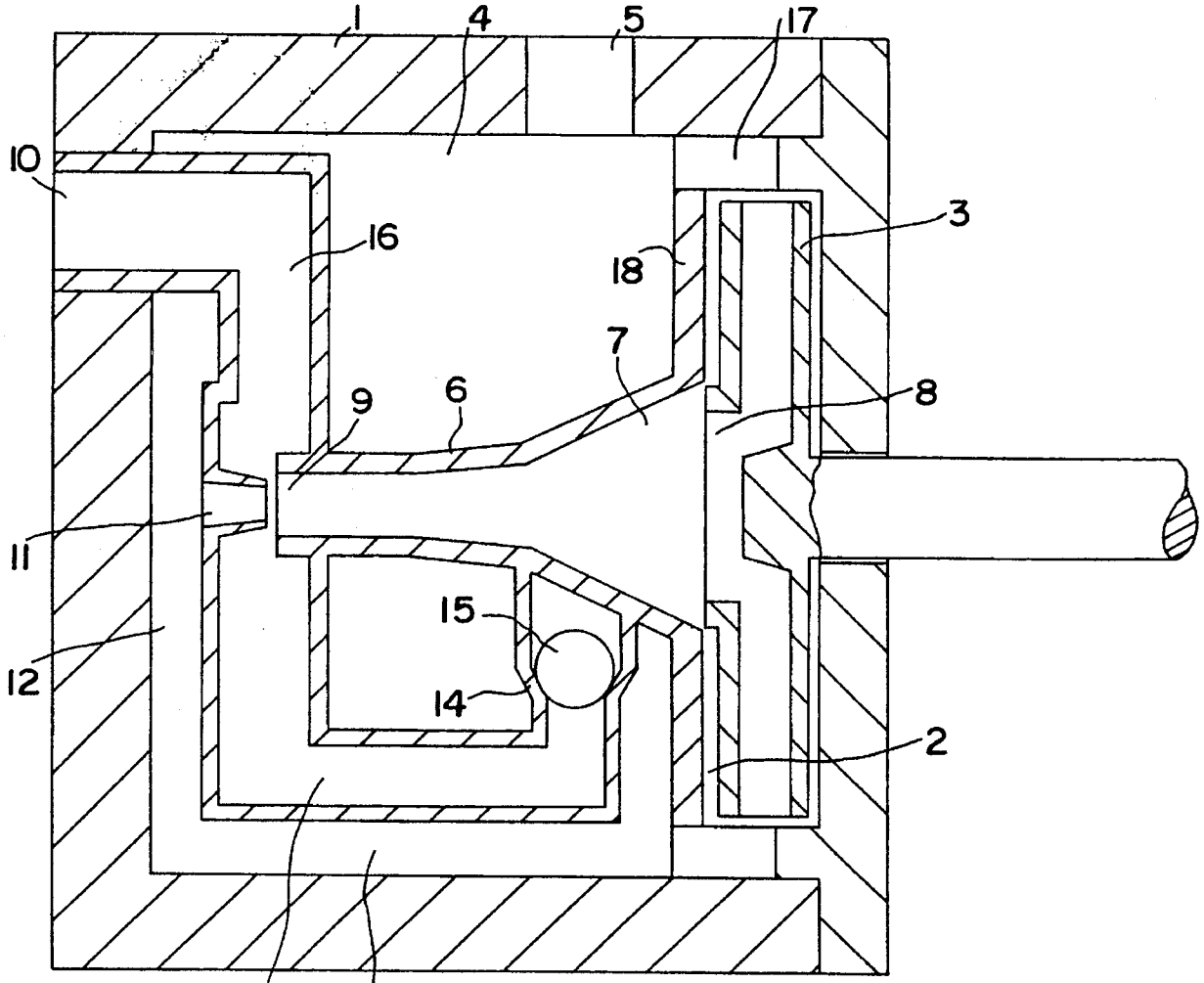
FIG. 1 is a schematic axial sectional view of one exemplary embodiment.

The pump construction in accordance with the invention will be described in more detail with reference to the drawing.

In its pump housing 1 the centrifugal pump has a pump chamber 2 which, in the exemplary embodiment, contains a pump impeller 3 rotating about a horizontal axis and is connected on the pressure side via openings 17 in a housing partition wall 18 to a working fluid chamber 4 disposed coaxially in the pump housing and is thus also in communication with a discharge passage 5 in the pump housing connected to the working fluid space 4. Connected coaxially upstream of the pump impeller 3 is a jet pump diffuser 6 whose broadened outlet 7 opens out in front of a suction opening 8 of the pump impeller 3 into the pump chamber 2 and whose constricted inlet 9 is connected to a suction passage 10 in the pump housing 1. Arranged in front of the diffuser inlet 9 is a drive nozzle 11 whose mouth within the suction passage 10 cooperates in the manner of an injector with the diffuser inlet 9 and which is connected via a supply passage 12 to the working liquid chamber 4.

In accordance with the invention, connected to the suction passage 10 of the pump housing 1 is a bypass line 13, which is formed in the pump housing and which leads directly from the suction passage 10 to the diffuser outlet 7 adjacent to the impeller suction opening 8, bypassing the diffuser inlet 9 cooperating with the drive nozzle 11. This bypass line includes a valve 14 which automatically closes the bypass line and whose valve body 15, which opens the bypass line 13 in the direction from the suction passage 10 to the impeller suction opening 8, is a ball in the illustrated exemplary embodiment. The specific gravity of the ball is greater by a predetermined amount than the specific gravity of the medium to be conveyed. The valve body can also be specifically lighter than the medium to be conveyed. It is then pressed downwardly against the opening direction of the valve 14 onto its valve seat by a spring (15') which produces a closing force. The closing force acting on the valve body 15 by virtue of its own weight or spring force is smaller than the pump suctional force at the diffuser outlet which acts on the valve when the centrifugal pump is operating at maximum output. The valve body 15 can thus be lifted away from the valve seat of the valve 14 by the suction action of the pump impeller as soon as the ultimate suction power of the rotary pump has built up.

The housing discharge passage 5 is connected to the upper region of the working fluid chamber 4. The working fluid chamber (4) is arranged coaxially with the pump impeller (3) and has an upper and a lower region. The discharge passage (5) in the pump housing (1) is connected to the upper region of the working fluid chamber (4). The supply passage (12) leading to the drive nozzle (10) is connected to the lower region of the working fluid chamber (4). Furthermore, the housing suction passage 10 has a section 16 which is situated higher than the outlet of the drive nozzle 11 in the diffuser inlet 9 so that the working fluid chamber 4 can be filled with a liquid working medium, when the pump is switched off, to above the jet pump device comprising the drive nozzle 11 and diffuser 6 or remains filled with flow medium as the working fluid.

On switching on of the pump, when initially air .is to be sucked out of the suction passage 10 and the full pump output and the ultimate discharge pressure can thus not yet build up, the valve 14 automatically holds the bypass line 13 closed so that the circulation of the working fluid effected by the pump impeller 3 for sucking out the air takes place exclusively from the working fluid space 4 through the drive nozzle 11, the diffuser 6 and through the pump chamber 2 back to the working fluid space 4. As soon as the suction passage 10 has completely filled up with the flow medium and the ultimate discharge pressure of the pump has built up, the suction force of the pump impeller rises so sharply that the valve body 15 is lifted up from the valve seat against the closing force. In addition to the flow medium, which is sucked in by the pump impeller through the narrow venturi nozzle of the jet pump device, flow medium is also sucked in directly by the pump impeller via the substantially larger bypass line 13, whereby a substantial increase is produced in the deliverable output flow automatically and without a change to the jet pump device.

In a modification from the exemplary embodiment illustrated in the drawing, it is also possible within the scope of the invention to retrofit an existing self-priming centrifugal pump with the improvement in accordance with the invention which consists principally of the bypass line 13 and bypass non-return valve 14.

We claim:

1. (Amended) Self-priming centrifugal pump for conveying a liquid medium including a pump housing (1) which has a suction passage (10) and a discharge passage (5), a pump chamber (2) which is provided in the pump housing (1) and has an inlet and an outlet, a pump impeller (3) which is arranged in the pump chamber (2) and which has a suction opening (8) opposed to the inlet of the pump chamber (2), a working fluid chamber (4) which is provided in the pump housing (1) and which is connected to the outlet of the pump chamber (2) and to the discharge passage (5) in the pump housing (1), a jet pump diffuser (6) which has a broadened outlet (7), in which a reduced pressure is produced, and a constricted inlet (9), the outlet (7) of the diffuser (6) being connected to the inlet of the pump chamber (2) whilst the inlet (9) of diffuser (6) is in communication with the suction passage (10) in the pump housing a jet pump drive nozzle (11) which has an inlet and an outlet, the inlet of the drive nozzle (11) being connected to a supply passage (12) connected to the working fluid chamber (4) whilst the outlet of the drive nozzle (11) within the suction passage (10) cooperates with the inlet (9) of the diffuser (6), a bypass line (13) which is connected to the suction passage (10) and leads to the outlet (7) of the diffuser (6) whilst bypassing its inlet (9), and a valve (14), which is arranged in the bypass line (13) and automatically closes it, with a valve body (15) which opens the bypass line (13) in the direction from the suction passage (10) to the outlet (7) of the diffuser (6), whereby acting on the valve body (15) in the direction from the outlet (7) of the diffuser (6) to the suction passage (10) there is a closing force which is smaller than an opening force which acts on the valve body (15) and which is produced by the reduced pressure in the outlet (7) of the diffuser at full discharge capacity of the centrifugal pump.

2. Self-priming rotary pump as claimed in claim 1, wherein the pump impeller (3) has an axis of rotation which is substantially horizontally directed, the working fluid chamber (4) is arranged coaxially with the pump impeller (3) and has an upper and a lower region, the discharge passage (5) in the pump housing (1) is connected to the upper region of the working fluid chamber (4), the supply passage (12) leading to the drive nozzle (10) is connected to the lower region of the working fluid chamber (4) and the suction passage (10) in the pump housing (1) has a section (16) which is situated higher than the outlet of the drive nozzle (11) and the inlet (9) of the diffuser (6).

3. Self-priming centrifugal pump as claimed in claim 1 or 2 wherein the closing force, which acts on the valve body (15) of the valve (14) arranged in the bypass line (13), is the force of gravity and the valve body (15) has a specific gravity which is greater by a predetermined amount than the specific gravity of the liquid medium to be conveyed.

4. Self-priming centrifugal pump as claimed in claim 3, characterised in that the valve body (15) is constructed as a ball.

* * * * *

UNITED STATES PATENT AND TRADEMARK OFFICE

CERTIFICATE OF CORRECTION

PATENT NO. : 5,474,418

DATED : December 12, 1995

INVENTOR(S) : Wessel et al.

It is certified that error appears in the above-identified patent and that said Letters Patent is hereby corrected as shown below:

In claim 1 in column 4 at line 17 after "pump housing" insert --(1),--.

Signed and Sealed this

Twenty-third Day of April, 1996

Bruce Lehman

*Attest:*

BRUCE LEHMAN

*Attesting Officer*

*Commissioner of Patents and Trademarks*